United States Patent [19]

Oseto et al.

[11] Patent Number: 4,591,262

[45] Date of Patent: May 27, 1986

[54] ELECTROSTATIC COPYING APPARATUS

[75] Inventors: Seiichi Oseto; Itaru Fujimura; Hitoshi Nakamura, all of Tokyo, Japan

[73] Assignee: Ricoh Company, Ltd., Tokyo, Japan

[21] Appl. No.: 75,790

[22] Filed: Sep. 17, 1979

[30] Foreign Application Priority Data

Sep. 22, 1978 [JP] Japan ..... 53-116921

[51] Int. Cl.[4] ..... G03G 15/02

[52] U.S. Cl. ..... 355/14 CH; 355/3 CH; 355/14 R

[58] Field of Search ..... 355/3 R, 3 CH, 14 R, 355/14 CH; 250/324, 325, 326; 361/229, 230, 235

[56] References Cited

U.S. PATENT DOCUMENTS 4,017,170 4/1977 Komori et al. ..... 355/3 R 4,141,648 2/1979 Gaitten et al. ..... 355/14 CH

FOREIGN PATENT DOCUMENTS 2609224 10/1976 Fed. Rep. of Germany ... 355/3 CH

*Primary Examiner*—Fred L. Braun

*Attorney, Agent, or Firm*—David G. Alexander

[57] ABSTRACT

A primary corona charging unit (13) applies a uniform electrostatic charge to a photoconductive drum (12) prior to radiation of the drum (12) with a light image of an original document (26) to form an electrostatic image. The electrostatic image is developed and transferred to a copy sheet (31) by use of a corona transfer charger (14) and separation charger (16). An A.C. corona discharger (17) discharges the drum (12) prior to recharging by the primary charger (13). The primary charger (13) is de-energized prior to the end of a copying operation to prevent charging of non-image areas of the drum (12). The copying operation is terminated by stopping rotation of the drum (12) and simultaneously de-energizing all of the other corona chargers (14), (16), (17). At the beginning of a copying operation, the corona chargers (14), (16), (17) are energized simultaneously with starting rotation of the drum (12). The primary charger (13) is not energized until sufficient time has elapsed for the leading edge of a portion of the drum (12) charged by all of the other chargers (14), (16), (17) to reach the primary charger (13).

7 Claims, 6 Drawing Figures

ELECTROSTATIC COPYING APPARATUS

BACKGROUND OF THE INVENTION

The present invention relates to an improved electrostatic copying machine or apparatus. In such an apparatus a primary corona charging unit applies a uniform electrostatic charge to a rotating photoconductive drum, belt or the like. A light image of an original document is radiated onto the drum to produce an electrostatic image through localized photoconduction. A developing unit applies toner to develop the electrostatic image into a toner image. The toner image is transferred and fixed to a copy sheet to provide a permanent copy. A transfer corona charger urges transfer of the toner image from the drum to the copy sheet whereas a separation corona charger facilitates separation of the copy sheet from the drum. A discharge corona charger typically energized with alternating voltage discharges the drum prior to recharging by the primary charger.

A problem has existed in such an apparatus in that the density of a first copy is lower than the density of subsequent copies. It has been determined that this problem is due to the fact that the electrostatic charge on the surface of the drum varies at different locations due to the status of the various corona chargers at the time the apparatus was de-energized at the termination of a previous copying operation.

Various means have been proposed to overcome this problem. One such expedient has been to increase the A.C. potential applied to the discharging corona charger. While this has succeeded in reducing the difference between the densities of the first and subsequent copies, it has introduced another problem in that a space charge of the same polarity as the primary charge injected from a conductive substrate or core of the drum into a photoconductive layer thereof is formed at the interface of the core and photoconductive layer. This space charge layer has a very detrimental effect on the image quality. Such a high A.C. potential is accompanied by a substantial increase in electrical power consumption and increases the electrical shock hazzard.

Another expedient has been to illuminate the drum with light in addition to or instead of applying the A.C. corona discharge. This prior art method, while somewhat reducing the difference in density between the first copy and subsequent copies does not completely eliminate said difference and accelerates the fatigue of the photoconductive drum.

SUMMARY OF THE INVENTION

An electrostatic copying apparatus embodying the present invention includes a photoconductive member, primary charging means and secondary charging means operatively disposed adjacent to the photoconductive member, the secondary charging means being disposed downstream of the primary charging means in a direction of movement of the photoconductive member, and is characterized by comprising:

control means for, at a beginning of a copying operation, energizing the secondary charging means and subsequently energizing the primary charging means after a sufficient period of time has elapsed for a leading edge of a portion of the photoconductive member charged by the secondary charging means to reach the primary charging means.

In accordance with the present invention, a primary corona charging unit applies a uniform electrostatic charge to a photoconductive drum prior to radiation of the drum with a light image of an original document to form an electrostatic image. The electrostatic image is developed and transferred to a copy sheet by means of a corona transfer charger and the copy sheet is separated from the drum by means of a separation charger. An A.C. corona discharger discharges the drum prior to recharging by the primary charger. The primary charger is de-energized prior to the end of a copying operation to prevent charging of non-image areas of the drum. The copying operation is terminated by stopping rotation of the drum and simultaneously de-energizing all of the other corona chargers. At the beginning of a copying operation, all corona chargers except the primary charger are energized simultaneously with starting rotation of the drum. The primary charger is not energized until sufficient time has elapsed for the leading edge of a portion of the drum charged by all of the other chargers to reach the primary charger.

It is an object of the present invention to provide an electrostatic copying apparatus comprising means for ensuring that the density of a first copy will be the same as a density of subsequent copies.

It is another object of the present invention to achieve the above said object without recourse to means which introduce other problems.

It is another object of the present invention to provide an improved electrostatic copying apparatus which utilizes a novel arrangement for timing the operation of corona charging units to ensure uniform copy density.

It is another object of the present invention to provide an electrostatic copying apparatus which may be manufactured economically and easily on a commercial production basis compared to the prior art.

It is another object of the present invention to provide a generally improved electrostatic copying apparatus.

Other objects, together with the foregoing, are attained in the embodiment described in the following description and illustrated in the accompanying drawing.

DESCRIPTION OF THE PREFERRED EMBODIMENT

While the electrostatic copying apparatus of the present invention is susceptible of numerous physical embodiments, depending upon the environment and requirements of use, substantial numbers of the herein shown and described embodiment have been made, tested and used, and all have performed in an eminently satisfactory manner.

Figure 1:
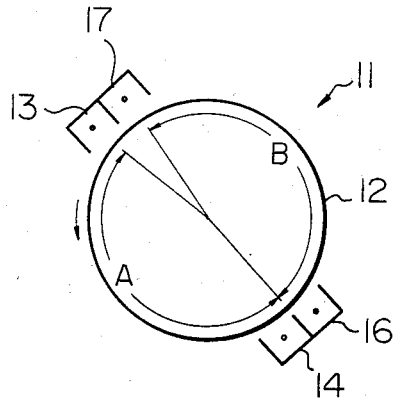
FIG. 1 is a diagram illustrating corona charging arrangements in an electrostatic copying machine.

Referring now to FIG. 1 of the drawing, an electrostatic copying apparatus 11 comprises a photoconductive drum 12 which is rotated counterclockwise at constant speed. A primary corona charging unit 13 applies a uniform positive electrostatic charge to the drum 12 prior to radiation with a light image of an original document (not shown) to form an electrostatic image. Located downstream of the charging unit 13 is a secondary charging means comprising a transfer charging unit 14, a separation charging unit 16 and a discharging unit 17, each of which comprises a corona charger. The transfer charging unit 14 applies a uniform positive electrostatic charge to the back of a copy sheet to urge toner image transfer from the drum 12 to the copy sheet, although not illustrated. The separation charging unit 16 applies an A.C. electrostatic charge to the copy sheet to facilitate separation thereof from the drum 12. The A.C. charge applied by the unit 16 is superimposed on a positive D.C. charge of small magnitude to prevent disruption of the toner image on the copy sheet during the separation operation. The discharging unit 17 applies an A.C. electrostatic charge to discharge or neutralize the drum 12 prior to another copying operation.

In the prior art, at the end of a copying operation the unit 13 is de-energized around the time the imaging operation ends to prevent charging of non-image areas of the drum 12. The units 14, 16 and 17 remain energized until the copy sheet is completely discharged from the apparatus 11, and are de-energized simultaneously with stopping rotation of the drum 12. At the time the drum 12 is stopped, an area A has been discharged by the unit 17 whereas an area B has been discharged by the unit 17 and also charged by the units 14 and 16. The electrostatic potential is higher (positive) in the area B than in the area A.

The area A has an electrostatic potential close to zero. However, the area B has been charged by both of the chargers 14 and 16 and has a positive potential. This positive potential decreases as a non-trivial function of time after the apparatus 11 is shut down and eventually approaches zero. Thus, if all of the units 13, 14, 16 and 17 are energized simultaneously as the drum 12 begins to rotate at the beginning of the next copying operation, after one operation by the units 17 and 13, the electrostatic potential in the area B will be lower than in the area A. As a result, the density of the first copy will be lower than the density of the second copy. This is because the potential in the area B, prior to operation by the unit 17, is low due to charge dissipation with time. The area A is charged by the units 14 and 16 prior to operation by the unit 17 and will therefore have a higher positive charge. However, the density of all copies following the first copy will be the same because all portions of the drum 12 are charged by the units 14 and 16 prior to discharging by the unit 17. The basic reason for this phenomenon is that the charges applied by the units 13, 14, and 16 are cumulative and cannot be completely dissipated by the unit 17.

It is known to overcome this undesirable uneven potential distribution by de-energizing the units 14 and 16 when the copy sheet is completely discharged and to maintain the drum 12 in rotation while energizing the unit 17 until the entire surface of the drum 12 has been discharged by the unit 17.

Where this expedient is resorted to, it has generally been practiced to energize the unit 17 simultaneously with starting rotation of the drum 12 at the beginning of a copying operation and energizing the unit 13 shortly thereafter in order to reduce the operating time. The units 14 and 16 are not energized until the copy sheet approaches the drum 12 for transfer. Thus, for the first copy, the portion of the drum 12 on which an electrostatic image was formed was charged only by the units 17 and 13.

Figure 2:
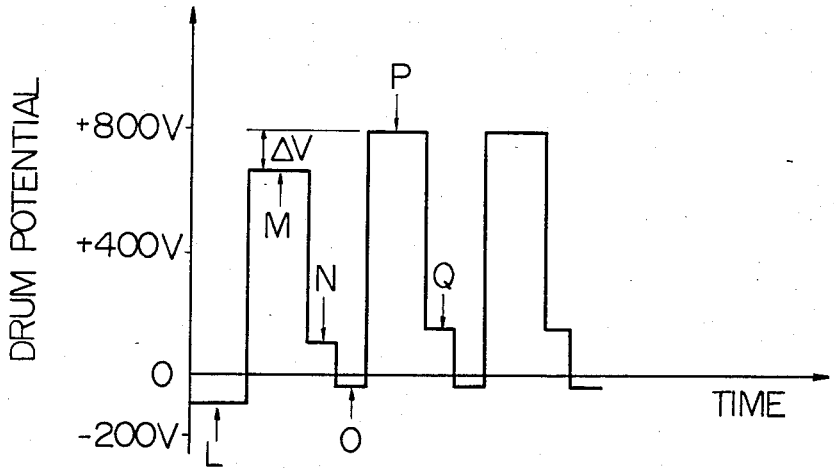
Fig. 2 PRIOR ART
FIG. 2 is a graph illustrating a problem which has existed in the prior art.

Since this portion of the drum 12 was not charged by the units 14 and 16, the electrostatic image potential is relatively low as illustrated in FIG. 2, measured after radiation with the light image. A portion L was discharged by the unit 17. A portion M corresponds to a dark image area. A portion N corresponds to a light image area. It will be understood that the unit 13 is energized only long enough to charge a portion of the drum 12 which is to be radiated with the light image. This prevents charging of non-image areas which would cause overloading of a developing unit and cleaning unit. The units 14 and 16 are energized when the copy sheet approaches the drum 12.

For the next and subsequent copies, a portion of the drum 12 charged by the units 14 and 16 has had time to reach the units 17 and 13 when the unit 13 is energized for making the next copy. Although the discharging unit 17 removes most of the charge on the drum 12 with A.C. corona discharge, a certain amount of the charge applied by the units 13, 14 and 16 remains. Thus, a potential in an area O is higher than the corresponding potential in the portion or area L for the second and first copies respectively. As a result, the potential in dark image area P for the second copy is higher by an amount $\Delta V$ than the corresponding potential in the area M for the first copy. A potential in an area Q corresponding to a light background area in the second copy is also higher than the potential in the area N for the first copy. Typically, the voltage difference $\Delta V$ ranges from 20 V to 150 V. As a result, the density of the first copy is lower than the density of the second and subsequent copies.

Figure 3:
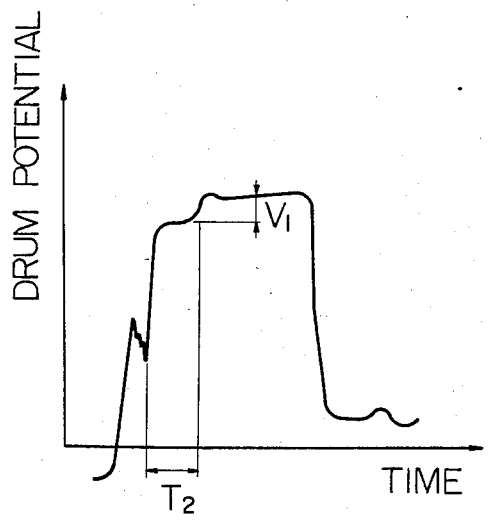
Fig. 3 PRIOR ART
FIG. 3 is another graph illustrating a prior art problem.

Even if the units 14 and 16 are energized simultaneously with the unit 17, low copy density of the first copy will still be present if the unit 13 is energized within a period of time T1 which is shorter than a period of time T2 required for the leading edge of the portion of the drum 12 charged by the units 14 and 16 to reach the unit 17. This is illustrated in FIG. 3 which shows that the maximum possible drum potential is not reached until the time period T2 elapses. There is a difference in potential equal to V1 between the portion of drum 12 which was not charged by the units 14 and 16 and the portion of the drum 12 which was charged by the units 14 and 16 in addition to the units 17 and 13.

It is also noteworthy that the potential on a photoconductive drum depends also on the polarity of applied charge. For example, for a drum having an aluminum substrate or core and a photoconductive layer of amorphous selenium and amorphous seleniumtellurium, the potential resulting from a positive corona discharge is 5–10 times larger than the potential resulting from a negative corona discharge with the same voltage applied to the corona charger.

Figure 4:
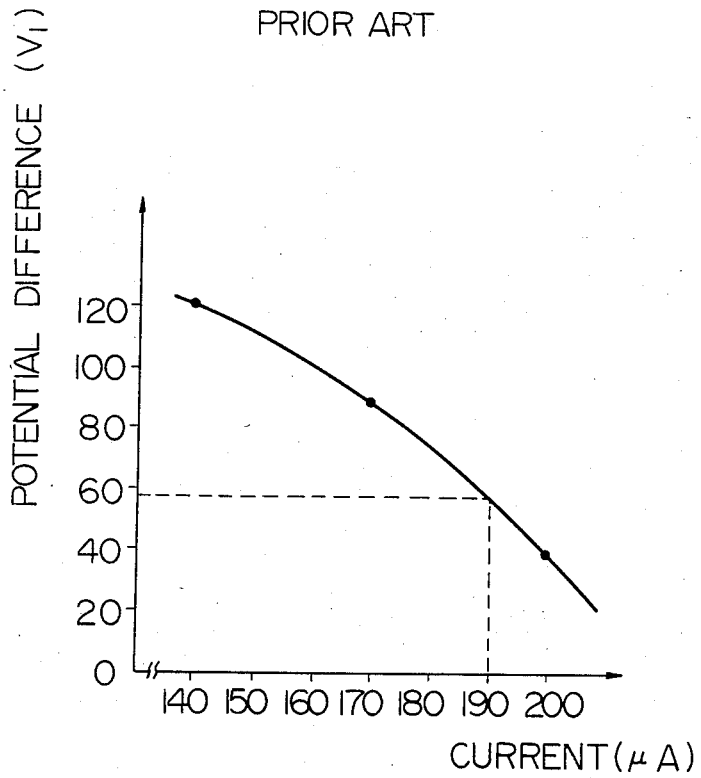
Fig. 4 PRIOR ART
FIG. 4 is a graph illustrating a prior art attempt to overcome said problems.

FIG. 4 illustrates the prior art expedient of increasing the power applied to the unit 17. The horizontal axis corresponds to the current flow through the photoconductive layer of the drum whereas the vertical axis corresponds to the potential difference V1 shown in FIG. 3. The current must be increased from around 140 microamperes to about 190 microamperes to reduce the potential difference V1 below 60 V. This is about the level which may be attained using light radiation. However, these expedients are undesirable for the reasons described above.

Figure 5:
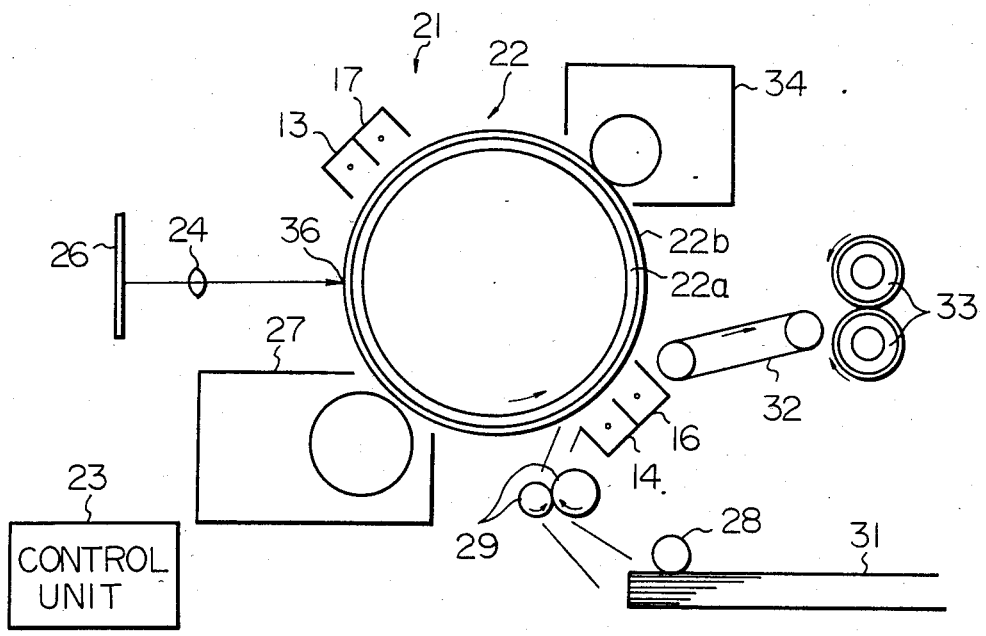
FIG. 5 is a schematic view of an electrostatic copying apparatus embodying the present invention.

Referring now to FIG. 5, an electrostatic copying apparatus embodying the present invention is designated as 21 and comprises a rotary photoconductive drum 22 which is driven counterclockwise at constant speed. The drum 22 comprises a conductive core or substrate *22a* on which is formed a photoconductive layer *22b*. The core *22a* is typically made of aluminum whereas the layer *22b* is a selenium based photoconductor. However, the layer *22b* may be selected from materials such as cadmium sulfide, zinc oxide or an organic photoconductor. It is also possible to use a three-layer photoconductive material having an outer insulative layer. The present invention may also be practiced using a polarity inversion or NP process. The drum 22 is typically 120 mm in diameter and rotated at a surface speed of 210 mm per second.

The charging units 13, 14 16 and 17 are illustrated and perform the same functions described with reference to FIG. 1. However, the rotation of the drum 22 and the energization of the units 13, 14, 16 and 17 are controlled by a control unit 23 in a novel and unique manner as will become understood from further description.

After uniform charging by the unit 13, an imaging means symbolized by a converging lens 24 focusses a light image of an original document 26 onto the drum 22 to form an electrostatic image through localized photoconduction. A developing unit 27 applies a powdered toner to the drum 22 to develop the electrostatic image into a toner image. A feed roller 28 and register rollers 29 feed a top copy sheet 31 from a stack into contact with the drum 22 at the same surface speed thereas. The timing of the sheet feed is such that the leading edge of the sheet 31 aligns with the leading edge of the toner image on the drum 22. The toner image is transferred from the drum 22 to the copy sheet 31 by means of the transfer charging unit 14. The charge applied by the separation charging unit 16 causes the copy sheet 31 to be separated from the drum 22. A conveyor 32 carries the copy sheet 31 from the drum 22 to fixing rollers 33 which fix the toner image to the copy sheet 31. A cleaning unit 34 removes residual toner from the drum 22 for recycling. The discharging unit 17 discharges the drum 22 prior to primary charging by the unit 13 in the manner described above.

Figure 6:
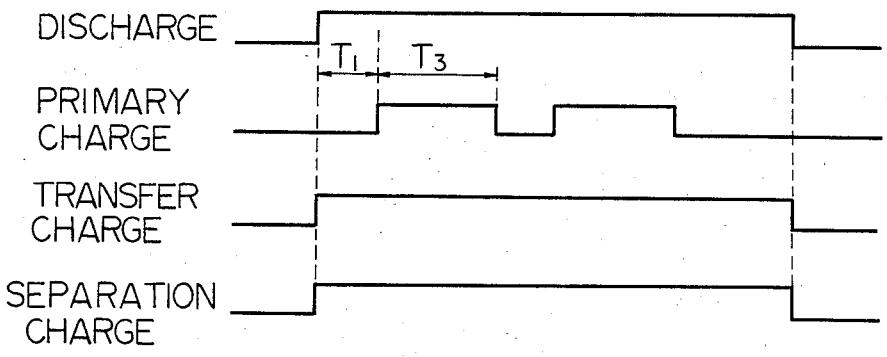
FIG. 6 is a timing diagram of the operation of the present copying apparatus.

FIG. 6 illustrates the operations of the discharging unit 17, primary charging unit 13, transfer charging unit 14 and separation charging unit 16 starting at the beginning of a copying operation. It will be assumed that it is desired to make a plurality of copies of either the same document or different documents. However, the operation is the same where it is desired to make only one copy.

In response to closing of a print switch (not shown), the control unit 23 causes the drum 22 to start rotation and causes the units 14, 16 and 17 to be energized simultaneously. After a time period T1 which is equal or greater than T2 has elapsed, the control unit 23 causes the primary charging unit 13 to be energized. Where T2 is 0.9 sec., T1 will typically be equal to T2+0.35 seconds or T1=1.25 sec. The unit 13 is energized only for a period T3 which is sufficient for a portion of the drum 22 on which the light image is radiated onto the drum 22 to be charged. Light image radiation is delayed by a length of time required for the leading edge of the charged portion of the drum 22 to reach an imaging position 36. At the end of the copying operation, after the desired number of copies are made, the control unit 23 causes the drum 22 to stop rotating and simultaneously causes the units 14, 16 and 17 to be deenergized. This results in the potential distribution illustrated in FIG. 1.

For the next copying operation, rotation of the drum 22 and energization of the units 14, 16 and 17 are begun simultaneously. However, the unit 13 is not energized until the time period T1 has elapsed. The time period T2, which is shorter than T1, is the length of time required for the leading (counterclockwise) edge of the portion or area A to reach the primary charging unit 13. Thus, all portions of the drum 22 which are charged by the unit 13 have been previously charged by the secondary charging means which consists of the units 17, 14 and 16. Thus, there will be no reduction of electrostatic charge potential and resulting image density for the first copy and all copies will have the same density.

The key point of the present invention is to delay energizing the primary charging unit 13 and thereafter the imaging exposure for the first copy until the leading edge of a portion of the drum 22 charged by all units of the secondary charging means reaches the primary charging unit 13. Various modifications are possible for those skilled in the art within the scope of the present disclosure. For example, the discharging unit 17 may be replaced by a lamp which functions to alter the charge on the drum 22 through photoconductive dissipation. The secondary charging means may comprise units other than the units 14, 16 and 17, for example, a cleaning charging unit disposed between the cleaning unit 34 and the separation charging unit 16, a corona charging unit disposed between the developing unit 27 and the transfer charging unit 14 to effectively attract or adhere the toner particles to the drum surface and the like. The present invention is of course applicable to wet process electrostatic copying as well as dry process copying.

In summary, it will be seen that the present invention overcomes the drawbacks of the prior art without introducing new problems such as undesirable space charge layers and accelerated drum fatigue. Since it is not necessary to energize the discharging unit 17 and drive the drum 22 after the copying operation is finished, the copying speed is maximized and unnecessary power consumption is eliminated. Various modifications in addition to those specifically recited above will become possible for those skilled in the art after receiving the teachings of the present disclosure without departing from the scope thereof.

What is claimed is:

1. An electrostatic copying apparatus including a rotary photoconductive member, primary charging means and secondary charging means operatively disposed adjacent to the photoconductive member, the secondary charging means being disposed downstream of the primary charging means in a direction of movement of the photoconductive member, characterized by comprising:

control means for, at a beginning of a copying operation, energizing the secondary charging means and subsequently energizing the primary charging means after a predetermined length of time has elapsed which is greater than a period of time required for a leading edge of a portion of the photoconductive member charged by the secondary charging means to reach the primary charging means.

2. An apparatus as in claim 1, further comprising imaging means disposed between the primary charging means and the secondary charging means for radiating a light image onto the photoconductive member.

3. An apparatus as in claim 2, in which the secondary charging means comprises at least one of a transfer charging unit, a sheet separation charging unit and a discharging unit.

4. An apparatus as in claim 2, in which the control means is constructed to energize the primary charging means only for a predetermined period of time sufficient to charge a portion of the photoconductive member on which the imaging means radiates the light image.

5. An apparatus as in claim 1, in which the primary charging means and the secondary charging means each comprise a corona charging unit.

6. An apparatus as in claim 1, in which the control means is further constructed to cause the photoconductive member to start rotating simultaneously with energizing the secondary charging means.

7. An apparatus as in claim 6, in which the control means is further constructed to, at an end of a copying operation, simultaneously de-energize the secondary charging means and stop rotation of the photoconductive member.

* * * * *